United States Patent [19]

Breton et al.

[11] Patent Number: 4,954,412

[45] Date of Patent: Sep. 4, 1990

[54] PROCESSES FOR THE PREPARATION OF ENCAPSULATED TONER COMPOSITIONS

[75] Inventors: Marcel P. Breton, Mississauga; Yves Deslandes, Gloucester; Guerino Sacripante, Cambridge, all of Canada

[73] Assignee: Xerox Corporation, Stamford, Conn.

[21] Appl. No.: 265,199

[22] Filed: Oct. 31, 1988

[51] Int. Cl.[5] ..... G03G 9/08

[52] U.S. Cl. ..... 430/137; 430/138

[58] Field of Search ..... 430/138, 137

[56] References Cited

U.S. PATENT DOCUMENTS

| | | | |
|---|---|---|---|
| 3,155,590 | 11/1964 | Miller et al. | 167/83 |
| 3,567,650 | 3/1971 | Bakan | 252/316 |
| 3,594,326 | 7/1971 | Himmel | 252/316 |
| 3,893,932 | 7/1975 | Azar et al. | 252/62.1 |
| 3,893,933 | 7/1975 | Brown | 252/62.1 |
| 4,298,672 | 11/1981 | Lu | 430/108 |
| 4,338,390 | 7/1982 | Lu | 430/106 |
| 4,345,015 | 8/1982 | Hendriksma et al. | 430/137 |
| 4,520,091 | 5/1985 | Kakimi et al. | 430/110 |
| 4,543,313 | 9/1985 | Mahabadi et al. | 430/109 |
| 4,560,635 | 12/1985 | Hoffend et al. | 430/106.6 |
| 4,699,866 | 10/1987 | Naoi et al. | 430/138 |
| 4,702,989 | 10/1987 | Sugiyama et al. | 430/137 |
| 4,725,522 | 2/1988 | Breton et al. | 430/138 |
| 4,766,051 | 8/1988 | Breton et al. | 430/138 |

FOREIGN PATENT DOCUMENTS 8704975 12/1984 PCT Int'l Appl. .

*Primary Examiner*—Paul R. Michl
*Assistant Examiner*—Stephen C. Crossan
*Attorney, Agent, or Firm*—E. O. Palazzo

[57] ABSTRACT

A process for the preparation of encapsulated toner compositions which comprises (1) providing a core comprised of a monomer capable of being polymerized by free radical polymerization, a colorant or pigment, a free radical initiator, a polymer and a first shell monomer dissolved in the core monomer; (2) dispersing said core components in an aqueous phase containing a surfactant, an antifoaming agent, and a phase transfer agent; (3) adding a second shell monomer to the aqueous phase; (4) encapsulating the core components by accomplishing polymerization of the first and second shell monomers; (5) heating the aqueous phase dispersion of (2) and (3) thereby effecting in situ polymerization of the core monomers; and (6) heat spheroidizing the polymerized shell of (4) by heating.

50 Claims, No Drawings

PROCESSES FOR THE PREPARATION OF ENCAPSULATED TONER COMPOSITIONS

BACKGROUND OF THE INVENTION

The present invention is generally directed to encapsulated compositions, and more specifically the present invention is directed to processes for the preparation of encapsulated toners wherein annealing and/or heat spheroidization is utilized for obtaining polymeric toner shells. Specifically, the present invention is directed to processes for encapsulated toner compositions wherein the shells thereof are obtained by interfacial polymerization and heat spheroidization, which shells are comprised of, for example, thermotropic liquid crystalline components as illustrated in U.S. Pat. No. 4,543,313, the disclosure of which is totally incorporated herein by reference; low melting polyesters, polyamides, polyureas, polyurethanes, polyester amides, and the like. Thus, in one embodiment, the process of the present invention comprises providing a core monomer or monomers, a colorant, shell monomers, a polymer or polymers, and a free radical initiator; dispersing the aforementioned core components in water containing a surfactant, an antifoaming agent and a phase transfer agent; adding shell monomers, including comonomers to the aqueous phase; polymerizing the shell monomers and heat spheroidizing thereby resulting in a polymeric shell with a softening point equal to or slightly above the temperature utilized for polymerization of the core material. The formed shell softens and anneals during the heat polymerization of the core monomers at temperatures of from, for example, about 40° to about 140° C., and preferably from about 65° to about 90° C., enabling encapsulated particles, especially toner compositions with smooth spherical morphologies. Also, the aforementioned annealing, or heat spheroidization process permits toner compositions with shells of more uniform characteristics. Thus, shells formed by an interfacial polymerization process at room temperature have, in most situations, a lower density in the inner shell as opposed to the outer shell. This results as shell formation is dependent on the diffusion characteristics of the monomers at the interface between the core and the shell. It is believed that with the process of the present invention wherein, for example, heat spheroidization is selected there results the formation of a more uniform shell. The aforementioned heat spheroidization process also permits encapsulated toner compositions in which the pigments are passivated by the shell, that is the heat spheroidization allows the formation of a very uniform polymeric coating over the core materials resulting in a toner with desirable electrical properties dependent on the properties of the coating for example. Moreover, additives can be incorporated into the shell as comonomers during the interfacial polymerization process. These additives modify in a controlled manner the electrical properties of the toner. It is also believed that the toner electrical properties can be modified by adding pigments such as carbon black and graphite to the surface, this addition being done during the heat spheroidization process in the presence of said pigments. Thus, with the process of the present invention in one embodiment there are obtained heat fusible toner compositions comprised of a polymeric core component, and thereover a thermotropic liquid crystalline polymeric shell. Also, the toner compositions of the present invention which in some embodiments possess core melting temperatures between about 60° to about 140° C. and preferably below 120° C., and shell melting temperatures between about 60° to about 140° C. and preferably between 80° and 120° C., permit a life extension of the fuser roll incorporated into electrostatographic, especially xerographic, imaging processes in that, for example, lower fusing energies can be selected, that is fusing can be effected at temperatures not exceeding 120° C. (fuser setting); and further the toner compositions of the present invention can be changed from about a −25 microcoulombs per gram to about a +25 microcoulombs per gram or other preselected values irrespective of the pigment selected for the core. This can be achieved, for example, with the appropriate choice of shell materials, shell additives, external additives and carriers for encapsulated toners obtained by the process of the present invention.

Of particular importance with respect to the toner compositions of the present invention is the enablement of shell melting at, for example, from about 60° C. to about 140° C., and preferably from about 80° to 120° C., which shell retains its characteristics, that is for example it does not fracture prematurely. Furthermore, when thermotropic liquid crystalline polymer shells are selected the encapsulated toners possess other important characteristics including, for example, the melting thereof over a narrow temperature interval; and wherein there is a substantial decrease in the mesophase melt viscosity before the clearing temperature, which is above the melting point of the resins or monomers subsequent to polymerization selected for the toner core.

The aforementioned toner compositions are useful for permitting the development of images in electrostatographic systems, inclusive of electrostatic imaging and printing processes. Also, the toner compositions prepared in accordance with the process of the present invention have shells with the advantages indicated herein including smooth surfaces with substantially no pinholes, or the avoidance of all pinholes in some instances, and a uniform continuous thickness around the core of the particles. This results in improved mechanical properties of the toner as compared to the properties of encapsulated toners prepared with a process not involving heat spheroidization. The shells prepared by the process described herein also have the added advantage of providing a superior insulation layer between the core materials and the outside of the particles, which results in improved passivating properties in some instances.

There is disclosed in Konishiroku Japanese Publication Nos. 60/198554 A2, 60/198555 A2, and Canon Japanese Publication No. 61/65260 A2 heat fusible encapsulated toner compositions in which the shell of the encapsulated toner is prepared by an overcoating process involving the use of an organic solvent and polymeric materials of high melting points with a sufficient glass transition temperature to provide good blocking properties for these compositions. The toner compositions of the present invention can contain similar core polymeric components, that is for example styrene acrylate and styrene methacrylate polymers; however, these cores are encapsulated, for example within a thermotropic liquid crystalline polymer component, which component is not illustrated in the aforementioned publications; and further the shells of the present invention are obtained by a heat spheroidization process. Accordingly, the toner compositions of the present invention have the advantages as indicated herein in that, for example, the thermotropic liquid crystalline shell components possess a combination of high glass transition temperatures and low melting points thereby enabling less fusing energies and reduced fixing pressures to be selected. Additionally, in contrast to the processes disclosed in the Japanese publications, the shells of the present invention are prepared by interfacial polymerization in a simplified continuous one step process wherein the core and the shell of the toner are simultaneously formulated, which process therefore is of lower cost, that is from about 15 to about 40 percent less than the aforementioned prior art processes.

With further reference to the prior art, there is disclosed in Japanese Publication No. 61/56352 A2, heat fusible encapsulated toner compositions with a core prepared by in situ free radical polymerization with an epoxy-urea shell of a very high melting temperature. These toners do not ordinarily possess low melting properties, that is they cannot be heat fixed with fusers set at temperatures as low as 120° C. In contrast, the toner compositions of the present invention can be used both in conventional heat fusing imaging systems wherein high melting materials with, for example, a softening point above 100° C. are required necessitating fuser temperatures of up to 180° C.; and in low melt applications as the shell and the core can be formulated accordingly. Also, the toner compositions of the present invention are believed to possess improved release properties from the fuser roll because of the presence of the thermotropic liquid crystalline shell, which component has acceptable wetting characteristics with respect to the substrate, such as paper or plastic film that is selected. Furthermore, the shell materials of the present invention can be annealed or heat spheroidized at temperatures below the boiling point of water, the medium in which encapsulated toners are usually prepared. This usually cannot be accomplished with shells of very high melting points, that is higher than 140° C., or cross-linked shells prepared from multifunctional monomers as opposed to the difunctional monomers used for this invention.

As a result of a patentability search, there were selected U.S. Pat. Nos. 4,345,015; 4,702,989; 4,520,091; 3,155,590; 3,567,650; 3,594,326; 3,893,932; 3,893,933 and 4,725,522. The '015 patent discloses the preparation of toner particles by heating and stirring irregularly shaped resin particles in hydrophobic silica particles of a liquid carrier such as water or mixture of water, and a water miscible organic solvent that does not dissolve the resin, with heating to a temperature at which the resin particles soften until they become spherical or almost spherical, followed by cooling of the dispersion and separating and drying the toner particles. In the '989 patent, there are illustrated, reference the Abstract of the Disclosure, pressure fixable toners prepared by the steps as indicated including heating the dispersion to evaporate off the solvent, dispersing the resulting encapsulated toner in a lower alcohol to remove the solvent remaining within the encapsulated toner, and thereafter drying the toner. Further details concerning this process are outlined in column 4, beginning at line 26, and note particularly column 4, beginning at line 61, and column 8, lines 15 to 28. Also of interest is Example I in column 10, lines 30 to 55. The '091 patent illustrates microcapsule toners which are spray dried at about 110° to 170° C., and further is treated by heating for a prolonged period of time at 80° to 150° C., reference column 3, beginning at line 14, for example. Also, note the disclosure in column 10, beginning at line 52, wherein it is indicated that the dried encapsulated toner is preferably heated to further improve its powder characteristics. The temperature for heating the dried encapsulated toner preferably ranges from 50° to 300°, and more preferably from 80° to 150° C. The other references listed were selected as being primarily of background interest.

Additionally, there are disclosed in Japanese Publication No. 61/118758 A2, Japanese Publication No. 59/218460 A2, Japanese Publication No. 61/28957 A2, Japanese Publication No. 60/175057 A2, and Japanese Publication No. 60/166958 A2 heat fusible toner compositions prepared by suspension polymerization. Examples illustrating colored photocapsule toners include U.S. Pat. Nos. 4,399,209; 4,482,624; 4,483,912 and 4,397,483. More specifically, the '483 patent illustrates encapsulated toner materials which have applications in very specific areas such as pressure sensitive recording paper. Capsules prepared for this application are usually coated on a substrate directly from the emulsion in which they are prepared and withstand with difficulties spray drying processes, a disadvantage alleviated with the toners prepared in accordance with the process of the present invention. Furthermore, these capsules contain an organic liquid in the core which, when used in a dry development system, could result in poor fix properties. Also, the range of particle sizes prepared by the aforementioned prior art process results in the formation of pressure sensitive recording particles which are usually not acceptable for electrostatographic development systems. The process of the present invention may, however, be selected for preparing capsule materials which could be used for the purposes described in the '483 patent. In the '209, '624, and the '912 patents, there are described toner compositions with costly encapsulated radiation sensitive components thereby necessitating the need for an image forming agent.

Moreover, there is disclosed in U.S. Pat. No. 4,476,211 the preparation of electrostatographic toner materials with surface electroconductivity. Specifically, there is disclosed in the '211 patent a cold pressure fixable toner composition with polyamide, polyurea and other types of shell materials prepared by an interfacial polymerization process. The colorant selected for these compositions is generally comprised of a variety of dyes or pigments, and the core contains a polymeric material with a binder therein for retaining the colorant within the core and assisting in the fixing of the colorant onto the surface of a support medium. Examples of high boiling liquids selected for the process of the '211 patent include those boiling at temperatures higher than 180° C. such as phthalic esters, phosphoric acid esters, and alkyl naphthalenes.

Furthermore, there are disclosed in U.S. Pat. No. 4,307,169 microcapsular electrostatic marking particles containing a pressure fixable core, and an encapsulating substance comprised of a pressure rupturable shell, wherein the shell, such as a polyamide, is formed by an interfacial polymerization. Additionally, there are disclosed in U.S. Pat. No. 4,407,922, pressure sensitive toner compositions obtained by interfacial polymerization processes, and comprised of a blend of two immiscible polymers selected from the group consisting of certain polymers as a hard component, and polyoctyldecylvinylether-co-maleic anhydride as a soft component. Moreover, illustrated in a copending application U.S. Ser. No. 621,307, the disclosure of which is totally incorporated herein by reference, are single component cold pressure fixable toner compositions, wherein the shell selected can be prepared by an interfacial polymerization process. A similar teaching is present in copending application U.S. Ser. No. 718,676, relating to cold pressure fixable toners, the disclosure of which is totally incorporated herein by reference. In the aforementioned application, the core can be comprised of magnetite and a polyisobutylene of a specific molecular weight encapsulated in a polymeric shell material generated by an interfacial polymerization process.

Additionally, there are illustrated in U.S. Pat. No. 4,543,313, the disclosure of which is totally incorporated herein by reference, toner compositions comprised of resin particles selected from the group consisting of thermotropic liquid crystalline polycarbonates, copolycarbonates, polyurethanes, polyesters, and copolyesters; and pigment particles. The aforementioned thermotropic liquid crystalline polymers, especially the polyesters and the polyurethanes, are useful as shells for the toner compositions of the present invention. However, the toner compositions of the '313 patent are not encapsulated and are prepared by conventional processes, such as melt blending and jetting.

There are also disclosed in copending application U.S. Ser. No. 043,265, the disclosure of which is totally incorporated herein by reference, toner compositions comprised of core components, and thereover a thermotropic liquid crystalline polymeric shell formulated by interfacial polymerization. Further, in this copending application there is described black or colored toner compositions comprised of a polymer core or polymer mixtures, and pigment particles encapsulated in a shell formulated by interfacial polymerization processes, which shell is selected from the group consisting of thermotropic liquid crystalline polyesters, polycarbonates, polyurethanes, copolycarbonates, and copolyesters, reference U.S. Pat. No. 4,543,313. Therefore, in one specific embodiment of the aforementioned copending application the toner compositions are comprised of a polymer core having dispersed therein as pigments components selected from the group consisting of black, cyan, magenta, yellow, red, magnetites, and mixtures thereof; and thereover a thermotropic liquid crystalline polymeric shell. Also, additive particles in an amount of from about 0.1 percent by weight to about 1 percent by weight, such as colloidal silicas, inclusive of Aerosils and/or metal salts or metal salts of fatty acids, inclusive of zinc stearate, can be added to the formulated encapsulated toner. Moreover, there can be incorporated into the toner compositions of the copending application charge enhancing additives in an amount of from about 1 percent to about 20 percent by weight to enable positively charged toner compositions, which additives include alkyl pyridinium halides, reference U.S. Pat. No. 4,298,672, the disclosure of which is totally incorporated herein by reference; sulfate and sulfonate compositions, reference U.S. Pat. No. 4,338,390, the disclosure of which is totally incorporated herein by reference; distearyl dimethyl ammonium methyl sulfate, reference U.S. Pat. No. 4,560,635, the disclosure of which is totally incorporated herein by reference; and the like. Furthermore, there are provided in accordance with the copending application processes for the preparation of toner compositions wherein the shell component is obtained by interfacial polymerization. One of the differences between the process of the present invention and the aforementioned copending application resides in the heat treatment of the shell materials in such a manner to induce permanent morphological changes within the shell. These changes are beneficial since they improve the materials prepared by the process of the present invention by rendering them less susceptible to cracking (more uniform thicknesses). Also, toners compositions prepared by the process of the present invention possess more uniform electrical properties and characteristics permitting their suitability for applications in which passivation of the electrical properties of the core components is needed, or desired.

In one preferred specific embodiment of the aforesaid copending application there are illustrated toner compositions comprised of a core of (1) a prepolymerized styrene-n-butylmethacrylate copolymer with a glass transition temperature of about 55° C. present in an amount of from about 1 percent to about 30 percent by weight, and preferably from about 10 percent by weight to about 20 percent by weight; and an in situ polymerized styrene polymer present in an amount of from about 30 to about 50 percent by weight of the toner; and (2) a mixture of magnetite, from about 1 percent to about 60 percent by weight, and preferably from about 1 percent to about 30 percent by weight, and carbon black from about 2 percent to about 15 percent by weight, and preferably from about 3 to about 10 percent by weight, encapsulated with a polyester thermotropic liquid crystalline shell present in an amount of from about 10 percent to about 25 percent by weight. The resulting toner has a core/shell morphology with a shell thickness of from about 0.05 to about 1.0 micron. With further respect to the specific aforementioned compositions, there can be present in the core either carbon black or magnetite in an amount of from about 3 to about 8 percent, and from about 15 to about 20 percent, respectively.

SUMMARY OF THE INVENTION

It is an object of the present invention to provide processes for the preparation of encapsulated toners with many of the advantages illustrated herein.

It is also an object of the present invention to provide processes for compositions comprised of a core encapsulated with thermotropic liquid crystalline shells formulated by an interfacial polymerization process, and heat spheroidization.

Still another object of the present invention is to provide improved encapsulated toner compositions with the advantages illustrated herein.

In another object of the present invention there are provided processes for encapsulated toner compositions with shells formulated by an interfacial polymerization process and heat spheroidization.

Also, in a further object of the present invention there are provided encapsulated toners with low melting characteristics.

Further, an additional object of the present invention resides in encapsulated black or colored toner compositions formulated by interfacial polymerization processes and heat spheroidization, which shells possess the advantages illustrated herein including uniform thickness, excellent passivating properities and smooth surface with no bare pigments protruding therefrom.

An additional object of the present invention resides in the provision of encapsulated toners that permit fuser life extension and improve wear resistance thereof in view of, for example, the lower fixing temperatures that can be selected for the toners obtained, and the selection of lower fusing energies, that is from about 25 to 50 percent, and preferably between 25 and 35 percent lower as compared to several known encapsulated toner compostions.

A further additional object of the present invention resides in the provision of processes for encapsulated toners with shells that withstand undesirable abrasions during processing and shipping.

Another object of the present invention resides in the provision of processes for the preparation of encapsulated toners wherein the shell need not be crosslinked. Noncrosslinked shells are suitable for use in designing heat fusible toners with improved characteristics such as lower fixing temperature, that is from about 120° to about 150° C. These toners can also be selected for the generation of xerographic encapsulated toners suitable for the formation of transparencies of improved quality, that is transparencies with clear images with no fuzziness upon projection.

Moreover, in another object of the present invention there are provided processes for toner compositions comprised of core components, and thermotropic liquid crystalline polymeric shells such as those illustrated in U.S. Pat. No. 4,543,313, the disclosure of which is totally incorporated herein by reference, which toners possess rapid flow with little shear or pressure at the appropriate fixing temperature, and wherein the core components penetrate the image substrate, such as paper or polymer films, enabling substantially permanently fixed images.

In another object of the present invention there are provided processes for the preparation of toner compositions comprised or core components, and liquid thermotropic shells as illustrated in U.S. Pat. No. 4,543,313, which toners are useful in electrophotographic imaging and printing processes.

In another object of the present invention there are provided developer compositions formulated by admixing carrier particles with the toner compositions obtained by the processes illustrated herein, which toners are comprised of core components, and liquid crystalline polymeric shells which can be charged to preselected values irrespective of the pigment selected for the core.

In another object of the present invention there are provided processes for toner compositions comprised of core components and liquid crystalline polymeric shells, which can be used in imaging systems without release mechanisms or agents, such as silicone oils on the fuser roll or within the toner itself.

These and other objects of the present invention are accomplished by the provision of processes for encapsulated toner compositions. More specifically, the present invention is directed to processes for the preparation of toner compositions, which comprises providing a core comprised of a core monomer or monomers, colorants, or pigment particles, a shell monomer, a polymer or polymers and a free radial initiator; dispersing the core components in an aqueous phase containing a surfactant, an antifoaming agent and a phase transfer agent; adding a second sheel monomer including comonomers to the aqueous phase; causing encapsulating of the core; effecting shell polymerization; and polymerizing the core monomers by heating wherein the polymeric shell and core resulting from the polymerizations possess many of the advantages illustrated herein including shell release from the core materials upon heating at temperatures of (sticking temperatures, the temperature at which the toner when heated, for example, on paper will stick to the paper), for example, from about 60° to about 140° C. and preferably between 80° and 100° C. Upon heating for an extended period of time at temperatures at from just below the shell release temperature to about 20° C. and preferably from just below the shell release temperature to about 15° C. below the shell release temperature, there results not only polymerization of the core monomer, but an annealing or heat spheroidization process which forms shells of improved properties as illustrated herein, including shells of uniform thickness with no pinholes and with smooth surfaces.

In one embodiment, the present invention is directed to a process for the preparation of encapsulated toner compositions which comprises (1) providing a core comprised of monomers capable of being polymerized by free radical polymerization, a colorant or pigment, a free radical initiator, a polymer and a shell monomer dissolved therein; (2) dispersing said core components in an aqueous phase containing a surfactant, an antifoaming agent and a phase transfer agent and adding a shell comonomer to the aqueous phase; (3) encapsulating the core components by accomplishing polymerization of the shell monomers; (4) heating the aqueous phase dispersion of (2) thereby effecting polymerization of the core monomers; and (5) heat spheroidizing the polymerized shell by heating. Another embodiment of the present invention relates to a process for the preparation of encapsulated toner compositions which comprises (1) providing a core comprised of monomers capable of being polymerized by free radical polymerization, a colorant or pigment, a free radical initiator, a polymer and a shell monomer dissolved therein; (2) dispersing said core components in an aqueous phase containing a surfactant, an antifoaming agent, and a phase transfer agent, and adding a shell comonomer to the aqueous phase; (3) encapsulating the core components by accomplishing polymerization of the shell monomers; (4) heating the aqueous phase dispersion of step (2) thereby effecting in situ polymerization of the core monomers; (5) heat spheroidizing the polymerized shell by heating at a temperature of from about 30° to about 0° C. below the sticking temperature of the toner; (6) washing the resulting toner particles with, for example, water and distilled water; and (7) drying the washed particles by various known tecniques.

Another embodiment of the present invention is directed to a process for the preparation of encapsulated toner compositions, which comprises (1) providing a core comprised of a monomer capable of being polymerized by free radical polymerization, a colorant or pigment, a free radical initiator, a polymer and a first shell monomer dissolved in the core monomer; (2) dispersing said core components in an aqueous phase containing a surfactant, an antifoaming agent, and a phase transfer agent; (3) adding a second shell monomer to the aqueous phase; (4) encapsulating the core components by accomplishing polymerization of the first and second shell monomers; (5) heating the aqueous phase dispersion of (2) and (3) thereby effecting in situ polymerization of the core monomers; and (6) heat spheroidizing the polymerized shell of (4) by heating.

Also, in a further specific embodiment of the present invention there is provided a process for the preparation of encapsulated toner compositions, which comprises (1) providing a core comprised of a monomer capable of being polymerized by free radical polymerization, a colorant or pigment, a free radical initiator, a polymer and a first shell monomer dissolved in the core monomer; (2) dispersing said core components in an aqueous phase containing a surfactant, an antifoaming agent, and a phase transfer agent; (3) adding a second shell monomer to the aqueous phase; (4) encapsulating the core components by accomplishing polymerization of the first and second shell monomers; (5) heating the aqueous phase dispersion of (2) and (3) thereby effecting polymerization of the core monomers; and (6) heat spheroidizing the polymerized shell at a temperature of from about 20° to about 0° C. below the sticking temperature of the resulting toner.

Toners obtained by the processes of the present invention can be comprised of core components, and thereover a thermotropic liquid crystalline polymeric shell formulated by interfacial polymerization and annealing or heat spheroidization. Nonliquid crystalline polymeric shells having softening points below about 120° C. and with acceptable glass transition temperature can also be selected for the process of the present invention. Further, in accordance with the present invention there are provided black or colored toner compositions comprised of a polymer core or polymer mixtures, and pigment particles encapsulated in a shell formulated by interfacial polymerization processes, which shell is selected from the group consisting of thermotropic liquid crystalline polyesters, polycarbonates, polyurethanes, polyamides, polyureas, copolycarbonates, and copolyesters, reference U.S. Pat. No. 4,543,313, the disclosure of which is totally incorporated herein by reference. Therefore, in one specific embodiment of the present invention the toner compositions formed are comprised of a polymer core having dispersed therein as pigments components selected from the group consisting of black, cyan, magenta, yellow, red, malgnetites, and mixtures thereof; and thereover a thermotropic liquid crystalline polymeric shell. Also, additive particles in an amount of from about 0.1 percent by weight to about 1 percent by weight, such as colloidal silicas, inclusive of Aerosils and/or metal salts or metal salts of fatty acids, inclusive of zinc stearate, can be added to the formulated encapsulated toner. Moreover, there can be incorporated into the toner compositions of the present invention charge enhancing additives in an amount of from about 0.5 percent to about 20, and preferably from about 0.5 percent to about 5 by weight to enable positively charged toner compositions, which additives include alkyl pyridinium halides, reference U.S. Pat. No. 4,298,672, the disclosure of which is totally incorporated herein by reference; sulfate and sulfonate compositions, reference U.S. Pat. No. 4,338,390, the disclosure of which is totally incorporated herein by reference; distearyl dimethyl ammonium methyl sulfate, reference U.S. Pat. No. 4,560,635, the disclosure of which is totally incorporated herein by reference; and the like. Furthermore, there are provided in accordance with the present invention processes for the preparation of compositions wherein the shell component, which is obtained by interfacial polymerization, possesses the characteristics illustrated herein.

One specific embodiment of the present invention relates to a process for obtaining toner compositions comprised of a core of (1) a prepolymerized styrene-n-butylmethyacrylate copolymer with a glass transition temperature of about 55° C. present in an amount of from about 1 percent by weight to about 30 percent by weight, and preferably from about 10 percent by weight to about 20 percent by weight; and an in situ polymerized n-butyl methacryate polymer present in an amount of from about 30 to about 50 percent by weight of the toner; and (2) carbon black from about 2 percent to about 15 percent by weight, and preferably from about 3 to about 10 percent by weight, encapsulated with a polyester thermotropic liquid crystalline shell present in an amount of from 1 to about 25 percent by weight of the toner and preferably from about 10 percent to about 25 percent by weight. The resulting toner has a core/-shell morphology with a shell thickness of from about 0.05 to about 1.0 micron. With further respect to the specific aforementioned compositions, there can be present in the core either carbon black or magnetite in an amount of from about 3 to about 8 percent, and from about 15 to about 20 percent by weight, respectively.

Various specific suitable polymers or mixtures, which mixtures contain, for example, from about 10 to about 90 percent by weight of a first polymer and from about 90 to about 10 percent by weight of a second polymer in an amount of from about 10 to about 85, and preferably from about 30 to about 85 percent by weight, can be selected for incorporation into the core of the toner compositions of the present invention providing that the objectives thereof are achievable. Also, three or more monomers may be selected for the toner core providing the objectives and the advantages of the present invention are achievable, illustrative examples of polymers include vinyl compositions such as polystyrenes, methacrylates, acrylates, polyolefins, mixtures thereof, and the like. Examples of specific core polymer components resulting from the polymerization of monomers include copolymers of styrene and methylmethyacrylates; styrene and methyacrylates; styrene and butadiene with a styrene content of greater than 75 percent by weight; styrene n-butylmethylacrylate copolymers; styrene n-lauryl methacrylate and the like, including terpolymers of the above. In a preferred embodiment of the present invention, the polymer and/or copolymer core is prepared in situ by free radical polymerization processes in the presence of a dissolved polymer in an amount of from about 5 percent to about 40 percent by weight of the total amount of core polymer, and in the presence of the selected pigment. Other polymers or mixtures thereof can be selected for the core providing the objectives of the present invention are achieved.

By in situ free radical polymerization processes as illustrated herein is meant a process in which a radically polymerizable monomer present in the organic phase is polymerized following the encapsulation of the organic phase. The in situ free radical polymerizations are initiated with azo type initiators present in an amount of from about 0.01 to about 2 percent by weight of the monomer selected. Examples of preferred initiators are 2,2' azo-bis-isobutyronitrile, 2,2' azo-bis-2,4-dimethylvaleronitrile, and Vazo® commercially available from E. I. DuPont Corporation. Also, mixtures of initiators can be selected in an amount that will permit a core polymer with the molecular and physical characteristics suitable for use as toner compositions. Also, examples of other initiators include those available from Pennwalt Corporation such as Lupersol®, Lucidol®, Luperco®, Alperox® and Decanox®. Control of polymerization rates and molecular weight is achievable through the use of difunctional or polyfunctional initiators in conjunction with an appropriate time-temperature profile for the polymerization reactions. Furthermore, diacyl peroxides can also be selected as initiators providing they are active at temperatures below 100° C. for the processes of in situ polymerization described therein.

Examples of core pigments or colorants present in various effective amounts of, for example, from about 3 to 70 percent by weight include carbon black, magnetities, and mixtures thereof; magenta, yellow, cyan, or mixtures thereof; and red pigments. Specific examples of pigments present in an amount of from about 5 to about 25 percent by weight in the toner include Heliogen Blue L6900, D6840, D7020, Sudan Blue OS available from BASF, Pylam Oil Yellow, Pigment Blue 1 available from Paul Uhlich & Company, Inc., Pigment Violet 1, and Pigment Red 48, also available from Uhlich & Company, Inc., Lemon Chrome Yellow DCC 1026, and Bon Red C available from Dominion Color Corp., Ltd., Toronto, Ontario, Canada, NOVAperm Yellow FGL, Hostaperm Pink E available from Hoechst, Cinquasia Magenta available from E. I. DuPont de Nemours & Company, chrome pigments, molybdate orange, benzidine yellow, the Hansa yellows, tartrazine lakes, cadmium yellows an oranges, zinc yellow, red lead, lithol reds, toluidine reds, Alizarine pigments, B.O.N. Maroon, tungstated rhodamines, Fire red pigments, Helio bordeaux reds and Watchung red. Also, as a substitute for the pigments there can be selected rubber based printing inks available from Canadian Fine Color Company, which inks are believed to be comprised of a polymer, and certain unknown inexpensive pigments.

In addition, there can be selected in place of the disclosed pigments dyes such as Oil Blue A, Passaic Oil Green, Sudan Red, Sudan Yellow 146, DuPont Oil Blue A, Passaic Oil Red 2144, Oil Yellow, Sudan Red 7B, Oil Pink 312, Pylachrome Pink LX1900, Sudan Black B, Ceres Blue R, Sudan Deep Black, and Ceres Black BN. The dye is usually present in the core in the amount of from about 1 percent to about 40 percent by weight, and preferably in an amount of from about 15 percent by weight to about 25 percent by weight.

The core may further contain additives in an amount of from 1 percent to about 40 percent by weight, and preferably in an amount of from about 1 to about 15 percent by weight, such as metallic soaps, waxes, silicone derivatives and/or other releasing agents, that is additives which reduce adhesion of the final toner to the fuser roll in imaging, especially xerographic apparatuses including metal salts of fatty acids such as zinc stearate. Moreover, to improve the toner flow properties and to control the electrical properties subsequent to encapsulation the toner compositions of the present invention can have added thereto surface components. These components, which are present in amounts of, for example, from about 0.1 to about 5 percent by weight, include colloidal silicas, such as Aersoil R972 and metal salts, and/or metal salts of fatty acids, reference U.S. Pat. Nos. 3,590,000; 3,655,374; 3,900,588; and 3,983,045, the disclosures of which are totally incorporated herein by reference.

As shell component examples present in an effective amount, for example from about 5 to about 25 percent by weight, there can be selected, for example, the thermotropic liquid polymers illustrated herein, or other low melting shells melting at temperatures lower than or equal to about 140° C. and preferably lower than or equal to about 120° C., and higher than 60° C. and preferably higher than 80° C., such as polyureas, polyamides, polyesters, polyester amides, polyurethanes, and the like, which polymers are formulated by interfacial polymerization and annealing or heat spheroidization. Interfacial polymerization processes selected for the shell formation are as illustrated, for example, in U.S. Pat. Nos. 4,000,087; 4,307,169; and 3,429,827, the disclosures of which are totally incorporated herein by reference. There are illustrated in U.S. Pat. No. 4,543,313, the disclosure of which is totally incorporated herein by reference, examples of shell monomers which can be selected as the thermotropic liquid crystalline shells for the compositions obtained by the process of the present invention. Specific examples of shells include thermotropic liquid crystalline polycarbonates, copolycarbonates, polyurethanes, polyesters, and copolyesters. In a preferred embodiment of the present invention, di(p-hydroxy methyl phenyl) terephthalate, p,p'-biphenol, terephthaloyl chloride, methyl-hydroquinone, azelaoyl chloride, sebacoyl chloride, and other aliphatic and aromatic diacid chlorides can be selected for the preparation of the thermotropic liquid crystalline shells.

Also, for the primary purpose of controlling the particle size of the particles or toners prepared by the process of the present invention, it is preferred to select a surfactant or a mixture of surfactants. The surfactants also stabilize the particles during the insitu polymerization phase and prevent aggregations of the particles. Examples of surfactants present in an effective amount of, for example, from about 0.05 percent to about 3 percent by weight of the aqueous phase, and preferably from about 0.05 to about 1 percent by weight include both ionic and nonionic surfactants, such as polyvinylalcohol, polyethylene sulfonic acid salt, carboxylated polyvinylalcohol, water soluble block copolymers such as the Pluronics® and Tetronics® commercially available from BASF, cellulose derivatives such as hydroxypropyl cellulose, hydroxyethyl cellulose, and the like; and inorganic sufactants such as trisodium polyphosphate, tricalcium polyphosphate, and the like. Lignosfulonate and polyelectrolyte dispersants can be also used, including those available from W. R. Grace as Daxad.

For the process of the present invention, the aqueous phase may contain, in addition to the surfactant or mixture of surfactants disclosed herein, an antifoaming agent such as aliphatic alcohols, preferably containing from about 8 to about 15 carbon atoms or more providing the alcohol is at least partially soluble in water, such as 2-decanol, which alcohol is present, for example, in an amount of from 0.01 to about 0.5 percent, and preferably from 0.01 to 0.1 percent. The primary function of the alcohol is to control foaming during the dispersion of the monomer mixture into the water mixture. As phase transfer agents, or components usually present in an amount of from, for example, about 0.001 to about 1 percent by weight of the aqueous phase, and preferably between 0.01 and 0.5 percent by weight, selected for the primary purposes of modification of the kinetics of interfacial polymerization; the kinetics of shell formation; controlling the yield of polymer shell formation; and improved molecular dispersion there are mentioned (1) ammonium salts such as benzyl triethyl ammonium chloride, benzyl triethyl ammonium bromide or other alkylated ammonium salts such as tetraethyl ammonium salts, and the like; and (2) crown ethers or cryptate type phase transfer agents such as benzo-18-crown-6, and the like. Other phase transfer agents that may be selected are illustrated in a compendium on phase transfer reactions, Georg Thieme Verlag Stuttgart, New York, 1986, the disclosure of which is totally incorporated herein by reference. The aqueous phase may also contain a free radical polymerization inhibitor in, for example, an effective amount, such as from about 0.01 percent to about 1.0 percent, and preferably from 0.01 to 0.1 percent by weight. Examples of inhibitors include alkali metal halides such as potassium iodide, potassium chloride, and the like; and a base component such as potassium hydroxide or sodium hydroxide, and the like providing that the objectives of the present invention are achievable.

One preferred method for the preparation of the encapsulated toner compositions of the present invention comprises (1) dispersing under vigorous agitation with a mechanical shaker carbon black in an amount of from about 2 percent to about 15 percent by weight of the toner, and preferably from 3 percent to 10 percent by weight; and magnetite in an amount of from about 1 percent to about 60 percent by weight of the toner, and preferably from 1 percent to 30 percent by weight of the toner; in a radically polymerizable monomer such as styrene or n-butylmethacrylate, and mixtures thereof present in an amount of from about 20 percent to about 80 percent by weight of the toner, and preferably from 40 percent to 60 percent by weight in which is dissolved a styrene-n-butylmethacrylate copolymer of a glass transition temperature of from about 25° C. to about 90° C., and preferably between 35° and 70° C., and present in an amount of from about 1 percent to about 30 percent by weight; and preferably between about 3 percent to about 10 percent by weight of the toner in the presence of a free radical polymerization initiator in an amount of from about 0.01 to about 1 percent by weight of monomer, and preferably between 0.01 to 0.5 percent by weight; (2) ball milling the resulting pigmented core dispersion obtained in step (1) for a period of about 16 hours with ½ by volume of 5 millimeter diameter ball bearings resulting in a well dispersed pigment solution; (3) in a separate container, dissolving in an aqueous solution p,p'-biphenol in an amount of from about 8 percent to about 30 percent by weight, and preferably from about 10 percent to about 20 percent by weight in the presence of an excess of sodium hydroxide, that is from about 1 to about 4 times the number of moles of p-p'-biphenol, and preferably from about 1.5 to about 3 times the number of moles of p-p'-biphenol; (4) transferring the ball milled solution to a 250 milliliter polyethylene bottle subsequent to removal of the balls; (5) adding to the pigment dispersion two free radical polymerization initiators, that is 2,2' azo-bis-isobutyronitrile of from about 0.01 to about 4 percent by weight of monomer, and preferably from about 0.3 percent to about 2 percent by weight of monomer, and 2,2' azo-bis-2,4-dimethyl-valeronitrile of from about 0.1 percent to about 3 percent by weight of monomer, and preferably from about 0.5 percent to about 1.8 percent by weight of monomer, and sebacoyl chloride or a mixture of acid chlorides in an amount of from 4 percent to about 30 percent by weight, and preferably from about 10 percent to about 25 percent by weight; (6) dispersing the mixture with a Brinkmann PT 45/80 homogenizer equipped with a PTA 35/4G probe generator for 20 seconds at 8,000 rpm into an aqueous solution of 1 percent hydroxylated polyvinylalcohol cooled at about 15° C., 500 milliliters, containing benzyltriethyl ammonium chloride, about 1.5 grams, and 2-decanol, about 0.5 gram; (7) transferring the water dispersion obtained in step (6) into a 2 liter reactor equipped with a mechanical stirrer, a reflux condenser and a heating bath under it; (8) adding to the 2 liter reactor the p-p'-biphenol solution obtained in step (3) over a period of 1 minute; (9) monitoring the pH of the water phase every 15 minutes for a period of 2 hours, which pH is maintained between 8 and 10 by addition of the required amount of dilute solution of hydrochloric acid, wherein an interfacial polymerization occurs between the acid chloride(s) and the p,p'-biphenol to yield a thermotropic liquid crystalline polyester shell; (10) adding potassium iodide, about 2.5 grams, to the dispersion; (11) heating the water dispersion at 60° C. for a period of 4 hours and a further 8 hours at 75° C. during which time the polyester shell is heat spheroidized; (12) cooling and then washing 3 times the resulting encapsulated toner particles with a basic sodium hydroxide solution, followed by washing with a dilute solution of hydrochloric acid, and washing 3 additional times with distilled water; and (13) drying the particles with a Yamato DL-41 spray dryer at an inlet temperature of about 130° C., or drying them with a Dura-Dry (FTS Systems, Inc.) freeze dryer, yielding free flowing toner particles which can then be selected for the imaging processes illustrated herein.

Examples of carrier particles and photoconductive imaging members that can be selected for use with the toner compositions of the present invention are described in U.S. Pat. No. 4,543,313, the disclosure of which is totally incorporated herein by reference. More specifically, illustrative examples of carrier materials that can be selected for mixing with the toner particles obtained by the process of the present invention include those substances that are capable of triboelectrically obtaining a charge of opposite polarity to that of the toner particles. Accordingly, the carrier particles of the present invention are selected so as to be of a negative or positive polarity enabling the toner particles that are positively, or negatively charged to adhere to and surround the carrier particles. Specific examples of carriers are granular zircon, granular silicon, methyl methacrylate, glass, steel, nickel, iron ferrites, and the like. The carriers are, in some embodiments of the present invention, preferably spherical in shape. Generally, from about 2 to about 5 parts per 100 parts by weight of carrier particles are admixed for the formation of the aforesaid developer compositions.

The selected carrier particles can be coated, the coating generally being comprised of fluoropolymers, such as polyvinylidene fluorides, terpolymers of styrene, methyl methacrylate, and a silane, inclusive of triethoxy silane, tetrafluoroethylenes, and the like.

The diameter of the carrier particles can vary. Generally, however, it is from about 50 microns to about 1,000 microns allowing these particles to possess sufficient density and inertia to avoid adherence to the electrostatic images during the development process. The carrier particles can be mixed with the toner particles in various suitable combinations, however, best results are obtained when about 1 part per toner to about 10 parts to about 200 parts by weight of carrier are mixed.

Examples of known photoconductive imaging members that can be selected include amorphous selenium, selenium alloys, layered members as illustrated in U.S. Pat. No. 4,265,990, the disclosure of which is totally incorporated herein by reference, and the like.

The following examples are being submitted to further define various species of the present invention. These examples are intended to be illustrative only and are not intended to limit the scope of the present invention. Also, parts and percentages are by weight unless otherwise indicated.

In these examples, the heat spheroidization temperature and the sticking temperature relationships are illustrated together with the toner morphologies. Very smooth and uniform toner shells, without pinholes, were obtained with the process selected for Examples I, V, IX and X. In these examples, the heat spheroidization temperature was 10°, 14°, 13° and 2° C., respectively, below the sticking temperature. In Example VI, the heat spheroidization temperature was 21° C. below the sticking temperature. The shell of this sample was characterized by folds and craters indicating poor or no heat spheroidization. In the other Examples there are differences between the heat spheroidization and the sticking temperature of 15° C. to 20° C. resulting in partial heat spheroidization with presence of pinhole like structures.

EXAMPLE I

A heat fusible encapsulated toner was prepared as follows: a styrene-n-butyl methacrylate copolymer of glass transition temperature of about 55° C. (7.95 grams) was dissolved in n-butyl methacrylate monomer (120.0 grams, available from Aldrich) in a 250 milliliter polyethylene bottle. A free radical polymerization inititiator (0.4 gram of Vazo-52 from Polysciences), and carbon black (10.02 grams of Regal 330®, available from Cabot) were added to the n-butyl methacrylate solution. This solution was ball milled for 16 hours with about ⅓ by volume of 5 millimeter diameter ball bearings to produce a well dispersed pigment solution. P,p'-biphenol (29.3 grams) was dissolved in a separate bottle in water (150 milliliters) in presence of sodium hydroxide (14.16 grams). The ball milled solution was then transferred to a 250 milliliter polyethylene bottle (133.11 grams without the balls) to which was further added sebacoyl chloride (9.41 grams, available from Aldrich, 99 percent), 3-methyl adipoyl chloride (7.75 grams, available from Aldrich, 97 percent), Vazo-52 (2.0 grams, available from Polysciences) and Vazo-64, another free radical polymerization initiator (2.4 grams, available from Polysciences). The resulting solution was dispersed with a PT 35/4G generator probe using a Brinkmann PT 45/80 homogenizer for 20 seconds at 8,000 rpm into a 1.0 percent, 500 milliliter, polyvinylalcohol, 88 percent hydroxylated, molecular weight 10,000 grams/mole, solution (available from Scientific Polymers Products) cooled at about 15° C. 2-decanol (available from Aldrich), 0.5 milliliter, was used to control foaming and benzyl triethyl ammonium chloride (1.465 grams) was used as a phase transfer agent. Subsequently, the dispersion was transferred into a 2 liter reactor with a heating bath thereunder equipped with a mechanical stirrer and a reflux condenser. While stirring, the p,p'-biphenol solution was added over a period of 1 minute. The pH was monitored and adjusted with a solution of sodium hydroxide to pH equal 8 to 10. The dispersion was kept at room temperature for 3 hours after transfer to the reactor. After this initial period, during which an interfacial reaction occurred between the sebacoyl chloride, the 3-methyl adipoyl chloride and the p,p'-biphenol there resulted a liquid crystalline polyester shell. Potassium iodide (2.5 grams) was then added to the dispersion. The toner dispersion was then heated to 60° C. for 4 hours and for a further 8 hours at 75° C. The resulting toner material was washed three times with a basic sodium hydroxide aqueous solution (pH=10). Thereafter, the water medium was acidified (pH=3) with hydrochloric acid and washing was affected three more times with distilled water. Subsequently, the washed toner particles were spray dried at an inlet temperature of about 130° C. and an outlet temperature of about 60° C. with a Yamato DL-41 spray dryer to yield 101.5 grams of dry toner having an average particle size of 7.1 microns with a geometric standard deviation of 1.32 as determined with a Coulter Counter. There resulted a black toner containing as core a poly(n-butyl methacrylate), about 71 percent by weight, a styrene-n-butyl methacrylate copolymer, about 4.7 percent by weight, carbon black, about 5.9 percent by weight and a polyester shell of about 18.4 percent by weight.

Subsequently, the shell release characteristics of the above prepared toner were measured using a heater plate on which was created a temperature gradient ranging from 60° to 130° C. A sample of these toner particles was distributed evenly between two xerographic papers which were put in contact with the hot plate. After reaching constant temperature, about one minute, the toner was gently pressed with a soft rubber roller against the plate and the two papers separated from one another. The lowest temperature at which the toner sticks to the paper in contact with the hot plate was referred to as the sticking temperature, that is the temperature at which the shell releases the core which then sticks to the paper. The toner prepared as described in the example has a sticking temperature of 95° C. A styrene-n-butyl methacrylate polymer resin having a sticking temperature of 90° C. was used as a standard in order to assure reproducibility in the determination of the sticking temperatures over a period of time. Scanning electron microscopy and transmission electron microscopy were selected to evaluate the morphology of the toner particles and the shell integrity. It was found that the particles were spherical in shape with a shell having a rough surface. The shells were characterized by the presence of very small pinhole like structures at the surface. Almost no shells were broken and the presence of carbon black in the shell was detectable by both scanning electron microscopy and transmission microscopy. Thereafter, 3 parts by weight of the resulting toner composition without additives was mixed with 100 parts by weight of a carrier consisting of an iron oxide core with a coating thereover of a polyvinylidine fluoride resin commercially available as Kynar, 0.14 percent coating weight. The triboelectric charge on the toner as measured in a known Faraday cage apparatus at a relative humidity of 50 percent was essentially zero microcoulombs per gram. Against a carrier consisting of a iron oxide core coated with a mixture of trifluorochlroroethylene/vinyl chloride resin (65:35 weight ratio and 1.3 percent by weight), commercially available as FDC 461 from Firestone, the coating being doped with 7.5 percent of carbon black, Regal 330® (available from Cabot), the triboelectric charge was +13.0 microcoulombs per gram.

EXAMPLE II

A heat fusible encapsulated toner was prepared as follows: a styrene-n-butyl methacrylate copolymer of glass transition temperature of about 55° C. (7.95 grams) was dissolved in n-butyl methacrylate monomer (120.0 grams, available from Aldrich) in a 250 milliliter polyethylene bottle. A free radical polymerization initiator (0.4 gram of Vazo-52 from Polysciences), and carbon black (10.02 grams, Regal 330®, available from Cabot) were added to the n-butyl methacrylate solution. This solution was ball milled for 16 hours with about ⅓ by volume of 5 millimeter diameter ball bearings to produce a well dispersed pigment solution. P,p'-biphenol (29.8 grams) was dissolved in a separate bottle in water (150 milliliters) in presence of sodium hydroxide (14.4 grams). The ball milled solution was then transferred to a 250 milliliters polyethylene bottle (135.3 grams without the balls) to which was further added azelaoyl chloride (9.01 grams, available from Fluka, 95 percent), 3-methyl adipoyl chloride (7.89 grams, available from Aldrich, 97 percent), Vazo-52 (2.0 grams, Polysciences) and Vazo-64, another free radical polymerization initiator (2.4 grams, available from Polysciences). The resulting solution was dispersed with a PT 35/4G generator probe using a Brinkmann PT 45/80 homogenizer for 20 seconds at 8,000 rpm into a 0.7 percent, 500 milliliter, polyvinylalcohol, 88 percent hydroxylated, molecular weight 10,000 grams/mole, solution (available from Scientific Polymers Products) cooled at about 15° C. 2-decanol (available from Aldrich), 0.5 milliliter, was used to control foaming and benzyl triethyl ammonium chloride (1.49 grams) was used as a phase transfer agent. Subsequently, the dispersion was transferred into a 2 liter reactor with a heating bath thereunder equipped with a mechanical stirrer and a reflux condenser. While stirring, the p,p'-biphenol solution was added over a period of 1 minute. The pH was monitored and adjusted with a solution of sodium hydroxide to pH equal 8 to 10. The dispersion was kept at room temperature for 3 hours after transfer to the reactor. After this initial period during which an interfacial reaction occurred between the azelaoyl chloride, the 3-methyl adipoyl chloride and the p,p'-biphenol there resulted a liquid crystalline polyester shell. Potassium iodide (2.5 grams) was then added to the dispersion. The toner dispersion was then heated to 60° C. for four hours and for a further ten hours at 80° C. The resulting toner material was washed three times with a basic sodium hydroxide aqueous solution (pH=10). Thereafter, the water medium was acidified (pH=3) with hydrochloric acid and washing was affected three more times with distilled water. Subsequently, the washed toner particles were spray dried at an inlet temperature of about 125° to 130° C. and an outlet temperature of about 55° to 60° C. with a Yamato DL-41 spray dryer to yield 107.2 grams of dry toner having an average particle size of 8.5 microns with a geometric standard deviation of 1.34 as determined with a Coulter Counter. There resulted a black toner containing as core a poly(n-butyl methacrylate), about 71 percent by weight, a styrene-n-butyl methacrylate copolymer, about 4.7 percent by weight, carbon black, about 5.9 percent by weight, and a polyester shell of about 18.4 percent by weight.

Subsequently, the shell release characteristics were measured using a heater plate on which was created a temperature gradient ranging from 60° to 130° C. A sample of these toner particles was distributed evenly between two xerographic papers which were put in contact with the hot plate. After reaching constant temperature, about one minute, the toner was gently pressed with a soft rubber roller against the plate and the two papers separated from one another. The toner prepared as described in the example has a sticking temperature of 90° C. A styrene-n-butyl methacrylate polymer resin having a sticking temperature of 90° C. was used as a standard in order to assure reproducibility in the determination of the sticking temperatures over a period of time. Scanning electron microscopy and transmission electron microscopy were used in order to evaluate the morphology of the particles and the shell integrity. It was found that the particles were spherical in shape with a shell having a smooth surface. There was no pinhole-like structures in the shell and no small dust particles on the surface. No broken particles were found by scanning electron microscopy and a minimum amount of CB was detectable near the shell surface by scanning electron microscopy. The particles prepared with the above shell composition may be used in xerographic processes. Thereafter, 3 parts by weight of the resulting toner composition was mixed with 100 parts by weight of a carrier consisting of an iron oxide core with a coating thereover of a polyvinylidine fluoride resin commercially available as Kynar, 0.14 percent coating weight. The triboelectric charge on the toner as measured in a known Faraday cage apparatus at a relative humidity of 50 percent was essentially zero microcoulombs per gram. Against a carrier consisting of an iron oxide core coated with a mixture of trifluorochloroethylene/vinyl chloride resin (65:35 weight ratio and 1.3 percent by weight), commercially available as FDC 461 from Firestone, the coating being doped with 7.5 percent of carbon black, Regal 330® (available from Cabot), the triboelectric charge was +8.9 microcoulombs per gram.

EXAMPLE III

A heat fusible encapsulated toner was prepared as follows: a styrene-n-butyl methacrylate copolymer (7.95 grams) of glass transition temperature of about 55° C. was dissolved in n-butyl methacrylate monomer (120.0 grams, available from Aldrich) in a 250 milliliter polyethylene bottle. A free radical polymerization initiator (0.4 gram of Vazo-52 from Polysciences), and carbon black (10.02 grams, Regal 330®, available from Cabot) were added to the n-butyl methacrylate solution. This solution was ball milled for 24 hours with about ⅓ by volume of 5 millimeter diameter ball bearings to produce a well dispersed pigment solution. P,p'-biphenol (28.8 grams) was dissolved in a separate bottle in water (150 milliliters) in presence of sodium hydroxide (13.97 grams). The ball milled solution was then transferred to a 250 milliliter polyethylene bottle (134.78 grams without the balls) to which was further added azelaoyl chloride (17.41 grams, available from Fluka, 95 percent), Vazo-52 (2.0 grams, available from Polysciences) and Vazo-64, another free radical polymerization initiator (2.4 grams, available from Polysciences). The resulting solution was dispersed with a PT 35/4G generator probe using a Brinkmann PT 45/80 homogenizer for 20 seconds at 8,000 rpm into a 0.7 percent, 500 milliliter, polyvinylalcohol, 88 percent hydroxylated, molecular weight 10,000 grams/mole, solution (available from Scientific Polymers Products) cooled at about 15° C. 2-decanol (available from Aldrich), 0.5 milliliter, was used to control foaming and benzyl triethyl ammonium chloride (1.49 grams) was used as a phase transfer agent. Subsequently, the dispersion was transferred into a 2 liter reactor with a heating bath thereunder equipped with a mechanical stirrer and a reflux condenser. While stirring, the p,p'-biphenol solution was added over a period of 1 minute. The pH was monitored and adjusted with a solution of sodium hydroxide to pH equal 8 to 10. The dispersion was kept at room temperature for 3 hours after transfer to the reactor. After this initial period, during which an interfacial reaction occurred between the azelaoyl chloride and the p,p'-biphenol there resulted a liquid crystalline polyester shell. Potassium iodide (2.5 grams) was then added to the dispersion. The toner dispersion was then heated to 60° C. for 4 hours and for a further 10 hours at 80° C. The resulting toner material was washed three times with a basic sodium hydroxide aqueous solution (pH=10). Thereafter, the water medium was acidified (pH=3) with hydrochloric acid and washing was affected three more times with distilled water. Subsequently, the washed toner particles were spray dried at an inlet temperature of about 125° to 130° C. and an outlet temperature of about 55° to 60° C. with a Yamato DL-41 spray dryer to yield 121.0 grams of dry toner having an average particle size of 7.5 microns with a geometric standard deviation of 1.42 as determined with a Coulter Counter. There resulted a black toner containing as core a poly(n-butyl methacrylate), about 71 percent by weight, a styrene-n-butyl methacrylate copolymer, about 4.7 percent by weight, carbon black, about 5.9 percent by weight, and a polyester shell of about 18.4 percent by weight.

Subsequently, the shell release characteristics were measured using a heater plate on which was created a temperature gradient ranging from 60° to 130° C. A sample of these toner particles was distributed evenly between two xerographic papers which were put in contact with the hot plate. After reaching constant temperature, about one minute, the toner was gently pressed with a soft rubber roller against the plate and the two papers separated from one another. The toner prepared as described in the example has a sticking temperature of 95° C. A styrene-n-butyl methacrylate polymer resin having a sticking temperature of 90° C. was used as a standard in order to assure reproducibility in the determination of the sticking temperatures over a period of time. Scanning electron microscopy and transmission electron microscopy were used in order to evaluate the morphology of the particles and the shell integrity. It was found that the particles were spherical in shape with a shell having a surface almost identical to the one of those particles prepared as described in Example I.

EXAMPLE IV

A heat fusible encapsulated toner was prepared as follows: a styrene-n-butyl methacrylate copolymer of glass transition temperature of about 55° C. (7.95 grams) was dissolved in n-butyl methacrylate monomer (120.0 grams, available from Aldrich) in a 250 milliliter polyethylene bottle. A free radical polymerization initiator (0.4 grams of Vazo-52 from Polysciences), and carbon black (10.02 grams, Regal 330®, available from Cabot) were added to the n-butyl methacrylate solution. This solution was ball milled for 24 hours with about ⅓ by volume of 5 millimeter diameter ball bearings to produce a well dispersed pigment solution. p,p'-biphenol (21.12 grams) and methyl hydroquinone (6.04 grams, available from Fluka, 98 percent) were dissolved in a separate bottle in water (150 milliliters) in presence of sodium hydroxide (14.5 grams). The ball milled solution was then transferred to a 250 milliliter polyethylene bottle (132.2 grams without the balls) to which was further added azelaoyl chloride (18.23 grams, available from Fluka 95 percent), Vazo-52 (2.0 grams, available from Polysciences) and Vazo-64, another free radical polymerization initiator (2.4 grams, available from Polysciences). The resulting solution was dispersed with a PT 35/4G generator probe using a Brinkmann PT 45/80 homogenizer for 20 seconds at 8,000 rpm into a 0.7 percent, 500 milliliter, polyvinylalcohol, 88 percent hydroxylated, molecular weight 10,000 grams/mole, solution (available from Scientific Polymers Products) cooled at about 13° to 15° C. 2-decanol (available from Aldrich), 0.5 milliliter, was used to control foaming and benzyl triethyl ammonium chloride (2.5 grams) was used as a phase transfer agent. Subsequently, the dispersion was transferred into a 2 liter reactor with a heating bath thereunder equipped with a mechanical stirrer and a reflux condenser. While stirring, the p,p'-biphenol solution was added over a period of 1 minute. The pH was monitored and adjusted with a solution of sodium hydroxide to pH equal 8 to 10. The dispersion was kept at room temperature for 3 hours after transfer to the reactor. After this initial period, during which an interfacial reaction occurred between the azelaoyl chloride, the methyl hydroquinone and the p,p'-biphenol there resulted a liquid crystalline polyester shell. Potassium iodide (2.5 grams) was then added to the dispersion. The toner dispersion was then heated to 60° C. for 4 hours and for a further 10 hours at 80° C. The resulting toner material was washed three times with a basic sodium hydroxide aqueous solution (pH=10). Thereafter, the water medium was acidified (pH=3) with hydrochloric acid and washing was affected three more times with distilled water. Subsequently, the washed toner particles were spray dried at an inlet temperature of about 125° to 130° C. and an outlet temperature of about 55° to 60° C. with a Yamato DL-41 spray dryer to yield 102.2 grams of dry toner having an average particle size of 8.9 microns with a geometric standard deviation of 1.42 as determined with a Coulter Counter. There resulted a black toner containing as core a poly(n-butyl methacrylate), about 71 percent by weight, a styrene-n-butyl methacrylate copolymer, about 4.7 percent by weight, carbon black, about 5.9 percent by weight, and a polyester shell of about 18.4 percent by weight.

Subsequently, the shell release characteristics were measured using a heater plate on which was created a temperature gradient ranging from 60° to 130° C. A sample of these toner particles was distributed evenly between two xerographic papers which were put in contact with the hot plate. After reaching constant temperature, about one minute, the toner was gently pressed with a soft rubber roller against the plate and the two papers separated from one another. The lowest temperature at which the toner sticks to the paper in contact was the sticking temperature. The toner prepared as described in the example has a sticking temperature of 98° C. A styrene-n-butyl methacrylate polymer resin having a sticking temperature of 90° C. was used as a standard in order to assure reproducibility in the determination of the sticking temperatures over a period of time. Scanning electron microscopy and transmission electron microscopy were used in order to evaluate the morphology of the particles and the shell integrity. It was found that the particles were spherical in shape with a shell having a surface with a morphology resembling the one of those particles prepared as described in Examples I and III but for fewer pinholelike structure at the surface.

EXAMPLE V

A heat fusible encapsulated toner was prepared as follows: a styrene-n-butyl methacrylate copolymer of glass transition temperature of about 55° C. (7.95 grams) was dissolved in n-butyl methacrylate monomer (120.0 grams, available from Aldrich) in a 250 milliliter polyethylene bottle. A free radical polymerization initiator (0.4 gram of Vazo-52 from Polysciences), and carbon black (10.02 grams, Regal 330®, available from Cabot) were added to the n-butyl methacrylate solution. This solution was ball milled for 16 hours with about ⅓ by volume of 5 millimeter diameter ball bearings to produce a well dispersed pigment solution. P,p'-biphenol (21.5 grams) and methyl hydroquinone (6.14 grams, available from Fluka, 98 percent) were dissolved in a separate bottle in water (150 milliliters) in presence of sodium hydroxide (14.5 grams). The ball milled solution was then transferred to a 250 milliliter polyethylene bottle (135.5 grams without the balls) to which was further added sebacoyl chloride (9.86 grams, available from Aldrich, 99 percent), 3-methyl adipoyl chloride (8.12 grams, available from Aldrich, 97 percent), Vazo-52 (2.0 grams, available from Polysciences) and Vazo-64, another free radical polymerization initiator (2.4 grams, available from Polysciences). The resulting solution was dispersed with a PT 35/4G generator probe using a Brinkmann PT 45/80 homogenizer for 20 seconds at 8,000 rpm into a 0.7 percent, 500 milliliter, polyvinylalcohol, 88 percent hydroxylated, molecular weight 10,000 grams/mole, solution (available from Scientific Polymers Products) cooled at about 13° to 15° C. 2-decanol (available from Aldrich), 0.5 milliliter, was used to control foaming, and benzyl triethyl ammonium chloride (2.5 grams) was used as a phase transfer agent. Subsequently, the dispersion was transferred into a 2 liter reactor with a heating bath thereunder equipped with a mechanical stirrer and a reflux condenser. While stirring, the p,p'-biphenol solution was added over a period of 1 minute. The pH was monitored and adjusted with a solution of sodium hydroxide to pH equal 8 to 10. The dispersion was kept at room temperature for 3 hours after transfer to the reactor. After this initial period during which an interfacial reaction occurred between the sebacoyl chloride, the 3-methyl adipoyl chloride, the methyl hydroquinone and the p,p'-biphenol there resulted a liquid crystalline polyester shell. Potassium iodide (2.5 grams) was then added to the dispersion. The toner dispersion was then heated to 60° C. for 4 hours and for a further 10 hours at 80° C. The resulting toner material was washed three times with a basic sodium hydroxide aqueous solution (pH=10). Thereafter, the water medium was acidified (pH=3) with hydrochloric acid and washing was affected three more times with distilled water.

Subsequently, the washed toner particles were spray dried at an inlet temperature of about 125° to 130° C. and an outlet temperature of about 55° to 60° C. with a Yamato DL-41 spray dryer to yield 123.1 grams of dry toner having an average particle size of 6.9 microns with a geometric standard deviation of 1.36 as determined with a Coulter Counter. There resulted a black toner containing as core a poly(n-butyl methacrylate), about 71 percent by weight, a styrene-n-butyl methacrylate copolymer, about 4.7 percent by weight, carbon black, about 5.9 percent by weight and a polyester shell of about 18.4 percent by weight. The shell release characteristics were measured using a heater plate on which was created a temperature gradient ranging from 60° to 130° C. A sample of these toner particles was distributed evenly between two xerographic papers which were put in contact with the hot plate. After reaching constant temperature, about one minute, the toner was gently pressed with a soft rubber roller against the plate and the two papers separated from one another. The lowest temperature at which the toner sticks to the paper in contact with the hot plate was the sticking temperature, that is the temperature at which the shell releases the core which then sticks to the paper. The toner prepared as described in the example has a sticking temperature of 94° C. A styrene-n-butyl methacrylate polymer resin having a sticking temperature of 90° C. was used as a standard in order to assure reproducibility in the determination of the sticking temperatures over a period of time. Scanning electron microscopy and transmission electron microscopy were used in order to evaluate the morphology of the particles and the shell integrity. It was found that the particles were spherical in shape with a shell having surface characteristics identical to the one of those particles prepared as described in Example II. Thereafter, 3 parts by weight of the resulting toner composition was mixed with 100 parts by weight of a carrier consisting of an iron oxide core with a coating thereover of a polyvinylidine fluoride resin commercially available as Kynar, 0.14 percent coating weight. The triboelectric charge on the toner as measured in a known Faraday cage apparatus at a relative humidity of 50 percent was essentially zero microcoulombs per gram. Against a carrier consisting of a iron oxide core coated with a mixture of trifluorochloroethylene/vinyl chloride resin (65:35 weight ratio and 1.3 percent by weight), commercially available as FDC 461 from Firestone, the coating being doped with 7.5 percent of carbon black, Regal 300® (available from Cabot), the triboelectric charge was +13.5 microcoulombs per gram. After 60 minutes on a paint shaker during which time the toner was submitted to impacts from the carrier, the tribocharge remained essentially unchanged at 14 microcoulombs per gram.

EXAMPLE VI

A heat fusible encapsulated toner was prepared as follows: a styrene-n-butyl methacrylate copolymer of glass transition temperature of about 55° C. (7.95 grams) was dissolved in n-butyl methacrylate monomer (120.0 grams, available from Aldrich) in a 250 milliliter polyethylene bottle. A free radical polymerization initiator (0.4 gram of Vazo-52 from Polysciences), and carbon black (10.02 grams, Regal 300®, available from Cabot) were added to the n-butyl methacrylate solution. This solution was ball milled for 16 hours with about ⅓ by volume of 5 millimeter diameter ball bearings to produce a well dispersed pigment solution. P,p'-biphenol (21.74 grams) and methyl hydroquinone (6.20 grams, available from Fluka, 98 percent) were dissolved in a separate bottle in water (150 milliliters) in presence of sodium hydroxide (14.5 grams). The ball milled solution was then transferred to a 250 milliliter polyethylene bottle (134.3 grams without the balls) to which was further added azelaoyl chloride (15.01 grams, available from Fluka, 95 percent), glutaryl chloride (2.82 grams, available from Fluka, purum grade), Vazo-52 (2.0 grams, available from Polysciences) and Vazo-64, another free radical polymerization initiator (2.4 grams, available from Polysciences). The resulting solution was dispersed with a PT 35/4G generator probe using a Brinkmann PT 45/80 homogenizer for 20 seconds at 8,000 rpm into a 0.7 percent, 500 milliliter, polyvinylalcohol, 88 percent hydroxylated, molecular weight 10,000 grams/mole, solution (available from Scientific Polymers Products) cooled at about 3° to 15° C. 2-decanol (available from Aldrich), 0.5 milliliter, was used to control foaming and benzyl triethyl ammonium chloride (2.5 grams) was used as a phase transfer agent. Subsequently, the dispersion was transferred into a 2 liter reactor with a heating bath thereunder equipped with a mechanical stirrer and a reflux condenser. While stirring, the p,p'-biphenol solution was added over a period of 1 minute. The pH was monitored and adjusted with a solution of sodium hydroxide to pH equal 8 to 10. The dispersion was kept at room temperature for 3 hours after transfer to the reactor. After this initial period, during which an interfacial reaction occurred between the azelaoyl chloride, the glutaryl chloride, the methyl hydroquinone and the p,p'-biphenol there resulted a liquid crystalline polyester shell. Potassium iodide (2.5 grams) was then added to the dispersion. The toner dispersion was then heated to 60° C. for 4 hours and for a further 11 hours at 80° C. The resulting toner material was washed three times with a basic sodium hydroxide aqueous solution (pH=10). Thereafter, the water medium was acidified (pH=3) with hydrochloric acid and washing was affected three more times with distilled water. Subsequently, the washed toner particles were spray dried at an inlet temperature of about 125° to 130° C. and an outlet temperature of about 55° to 60° C. with a Yamato DL-41 spray dryer to yield 135.8 grams of dry toner having an average particle size of 9.1 microns with a geometric standard deviation of 1.62 as determined with a Coulter Counter. There resulted a black toner containing as core a poly(n-butyl methacrylate), about 71 percent by weight, a styrene-n-butyl methacrylate copolymer, about 4.7 percent by weight, carbon black, about 5.9 percent by weight, and a polyester shell of about 18.4 percent by weight.

Thereafter, the shell release characteristics were measured using a heater plate on which was created a temperature gradient ranging from 60° to 130° C. A sample of these toner particles was distributed evenly between two xerographic papers which were put in contact with the hot plate. After reaching constant temperature, about one minute, the toner was gently pressed with a soft rubber roller against the plate and the two papers separated from one another. The toner prepared as described in the example has a sticking temperature of 101° C. A styrene-n-butyl methacrylate polymer resin having a sticking temperature of 90° C. was used as a standard in order to assure reproducibility in the determination of the sticking temperatures over a period of time. Scanning electron microscopy and transmission electron microscopy were used in order to evaluate the morphology of the particles and the shell integrity. It was found that the particles were spherical in shape with a shell characterized by the presence of fines on the surface. The shell surface is very uneven and one can detect by scanning electron microscopy the presence of folds and craters, indicating a less effective heat spheriodization process as compared with Example II, an encapsulated toner having a lower sticking temperature.

EXAMPLE VII

A heat fusible encapsulated toner was prepared as follows: a styrene-n-butyl methacrylate copolymer of glass transition temperature of about 55° C. (7.95 grams) was dissolved in n-butyl methacrylate monomer (120.0 grams, available from Aldrich) in a 250 milliliter polyethylene bottle. A free radical polymerization initiator (0.4 gram of Vazo-52 from Polysciences), and carbon black (10.02 grams, Regal 330®, available from Cabot) were added to the n-butyl methacrylate solution. This solution was ball milled for 16 hours with about ⅓ by volume of 5 millimeter diameter ball bearings to produce a well dispersed pigment solution. P,p'-biphenol (21.12 grams) and methyl hydroquinone (6.04 grams, available from Fluka, 98 percent) were dissolved in a separate bottle in water (150 milliliters) in presence of sodium hydroxide (14.5 grams). The ball milled solution was then transferred to a 250 milliliter polyethylene bottle (135.7 grams without the balls) to which was further added sebacoyl chloride (15.49 grams, available from Aldrich, 99 percent), glutaryl chloride (2.74 grams, available from Fluka, purum grade), Vazo-52 (2.0 grams, available from Polysciences) and Vazo-64, another free radical polymerization initiator (2.4 grams, available from Polysciences). The resulting solution was dispersed with a PT 35/4G generator probe using a Brinkmann PT 45/80 homogenizer for 20 seconds at 8,000 rpm into a 0.7 percent, 500 milliliter, polyvinylalcohol, 88 percent hydroxylated, molecular weight 10,000 grams/mole, solution (available from Scientific Polymers Products) cooled at about 3° to 15° C. 2-decanol (available from Aldrich), 0.5 milliliter, was used to control foaming, and benzyl triethyl ammonium chloride (2.5 grams) was used as a phase transfer agent. Subsequently, the dispersion was transferred into a 2 liter reactor with a heating bath thereunder equipped with a mechanical stirrer and a reflux condenser. While stirring, the p,p'-biphenol solution was added over a period of 1 minute. The pH was monitored and adjusted with a solution of sodium hydroxide to pH equal 8 to 10. The dispersion was kept at room temperature for 3 hours after transfer to the reactor. After this initial period during which an interfacial reaction occurred between the sebacoyl chloride, the glutaryl chloride, the methyl hydroquinone and the p,p'-biphenol there resulted a liquid crystalline polyester shell. Potassium iodide (2.5 grams) was then added to the dispersion. The toner dispersion was then heated to 60° C. for 4 hours and for a further 10 hours at 80° C. The resulting toner material was washed three times with a basic sodium hydroxide aqueous solution (pH=10). Thereafter, the water medium was acidified (pH=3) with hydrochloric acid and washing was affected three more times with distilled water.

Thereafter, the washed toner particles were spray dried at an inlet temperature of about 125° to 130° C. and an outlet temperature of about 55° to 60° C. with a Yamato DL-41 spray dryer to yield 118.9 grams of dry toner having an average particle size of 8.0 microns with a geometric standard deviation of 1.35 as determined with a Coulter Counter. There resulted a black toner containing as core a poly(n-butyl methacrylate), about 71 percent by weight, a styrene-n-butyl methacrylate copolymer, about 4.7 percent by weight, carbon black, about 5.9 percent by weight, and a polyester shell of about 18.4 percent by weight.

The shell release characteristics were measured using a heater plate on which was created a temperature gradient ranging from 60° to 130° C. A sample of these toner particles was distributed evenly between two xerographic papers which were put in contact with the hot plate. After reaching constant temperature, about one minute, the toner was gently pressed with a soft rubber roller against the plate and the two papers separated from one another. The toner prepared as described in the example has a sticking temperature of 98° C. A styrene-n-butyl methacrylate polymer resin having a sticking temperature of 90° C. was used as a standard in order to assure reproducibility in the determination of the sticking temperatures over a period of time. Scanning electron microscopy and transmission electron microscopy were used in order to evaluate the morphology of the particles and the shell integrity. It was found that the particles were spherical in shape with some of them being broken. The shells are characterized by the presence of hole-like structures on the surface which makes the particles very rough.

EXAMPLE VIII

A heat fusible encapsulated toner was prepared as follows: a styrene-n-butyl methacrylate copolymer of glass transition temperature of about 55° C. (7.95 grams) was dissolved in n-butyl methacrylate monomer (120.0 grams, available from Aldrich) in a 250 milliliter polyethylene bottle. A free radical polymerization initiator (0.4 gram of Vazo-52 from Polysciences), and carbon black (10.02 grams, Regal 330 ®, available from Cabot) were added to the n-butyl methacrylate solution. This solution was ball milled for 16 hours with about ⅓ by volume of 5 millimeter diameter ball bearings to produce a well dispersed pigment solution. P,p'-biphenol (18.39 grams) and methyl hydroquinone (8.17 grams, available from Fluka, 98 percent) were dissolved in a separate bottle in water (150 milliliters) in presence of sodium hydroxide (14.5 grams). The ball milled solution was then transferred to a 250 milliliter polyethylene bottle (135.9 grams, without the balls) to which was further added azelaoyl chloride (18.52 grams, available from Fluka, 95 percent), Vazo-52 (2.0 grams, available from Polysciences) and Vazo-64, another free radical polymerization initiator (2.4 grams, available from Polysciences). The resulting solution was dispersed with a PT 35/4G generator probe using a Brinkmann PT 45/80 homogenizer for 20 seconds at 8,000 rpm into a 0.7 percent, 500 milliliter, polyvinylalcohol, 88 percent hydroxylated, molecular weight 10,000 grams/mole, solution (available from Scientific Polymers Products) cooled at about 3° to 15° C. 2-decanol (available from Aldrich), 0.5 milliliter, was used to control foaming, and benzyl triethyl ammonium chloride (2.5 grams) was used as a phase transfer agent. Subsequently, the dispersion was transferred into a 2 liter reactor with a heating bath thereunder equipped with a mechanical stirrer and a reflux condenser. While stirring, the p,p'-biphenol solution was added over a period of 1 minute. The pH was monitored and adjusted with a solution of sodium hydroxide to pH equal 8 to 10. The dispersion was kept at room temperature for 3 hours after transfer to the reactor. One hundred milliliters (100) of water were added to the dispersion after the first hour. After this initial period, during which an interfacial reaction occurred between the azelaoyl chloride, the methyl hydroquinone and the p,p'-biphenol there resulted a liquid crystalline polyester shell. Potassium iodide (2.5 grams) was then added to the dispersion. The toner dispersion was then heated to 60° C. for 4 hours and for a further 10 hours at 80° C. The resulting toner material was washed three times with a basic sodium hydroxide aqueous solution (pH=10). Thereafter, the water medium was acidified (pH=3) with hydrochloric acid and washing was affected three more times with distilled water. Subsequently, the washed toner particles were spray dried at an inlet temperature of about 125° to 130° C. and an outlet temperature of about 55° to 60° C. with a Yamato DL-41 spray dryer to yield 130.8 grams of dry toner having an average particle size of about 8.0 microns as determined by scanning electron microscopy. There resulted a black toner containing as core a poly(n-butyl methacrylate), about 71 percent by weight, a styrene-n-butyl methacrylate copolymer, about 4.7 percent by weight, carbon black, about 5.9 percent by weight, and a polyester shell of about 18.4 percent by weight.

Thereafter, the shell release characteristics were measured using a heater plate on which was created a temperature gradient ranging from 60° to 130° C. A sample of these toner particles was distributed evenly between two xerographic papers which were put in contact with the hot plate. After reaching constant temperature, about one minute, the toner was gently pressed with a soft rubber roller against the plate and the two papers separated from one another. The toner prepared as described in the example has a sticking temperature of 96° C. A styrene-n-butyl methacrylate polymer resin having a sticking temperature of 90° C. was used as a standard in order to assure reproducibility in the determination of the sticking temperatures over a period of time. Scanning electron microscopy and transmission electron microscopy were used to evaluate the morphology of the particles and the shell integrity. It was found that the particles were spherical in shape with morphology characteristics identical to those described in Example IV.

EXAMPLE IX

A heat fusible encapsulated toner was prepared as follows: a styrene-n-butyl methacrylate copolymer of glass transition temperature of about 55° C. (7.95 grams) was dissolved in n-butyl methacrylate monomer (120.0 grams, available from Aldrich) in a 250 milliliter polyethylene bottle. A free radical polymerization initiator (0.4 gram of Vazo-52 from Polysciences), and carbon black (10.02 grams, Regal 330 ®, available from Cabot) were added to the n-butyl methacrylate solution. This solution was ball milled for 16 hours with about ⅓ by volume of 5 millimeter diameter ball bearings to produce a well dispersed pigment solution. P,p'-biphenol (19.08 grams) and methyl hydroquinone (8.48 grams, available from Fluka, 98 percent) were dissolved in a separate bottle in water (150 milliliters) in presence of sodium hydroxide (14.5 grams). The ball milled solution was then transferred to a 250 milliliter polyethylene bottle (134.9 grams without the balls) to which was further added azelaoyl chloride (9.61 grams, available from Fluka, 95 percent), 3-methyl adipoyl chloride (8.41 grams, available from Aldrich, 97 percent), Vazo-52 (2.0 grams, available from Polysciences) and Vazo-64, another free radical polymerization initiator (2.4 grams, available from Polysciences). The resulting solution was dispersed with a PT 35/4G generator probe using a Brinkmann PT 45/80 homogenizer for 20 seconds at 8,000 rpm into a 0.7 percent, 500 milliliter, polyvinylalcohol, 88 percent hydroxylated, molecular weight 10,000 grams/mole, solution (available from Scientific Polymers Products) cooled at about 3° to 15° C. 2-decanol (available from Aldrich), 0.5 milliliter, was used to control foaming, and benzyl triethyl ammonium chloride (2.5 grams) was used as a phase transfer agent. Subsequently, the dispersion was transferred into a 2 liter reactor with a heating bath thereunder equipped with a mechanical stirrer and a reflux condenser. While stirring, the p,p'-biphenol solution was added over a period of 1 minute. The pH was monitored and adjusted with a solution of sodium hydroxide to pH equal 8 to 10. The dispersion was kept at room temperature for 3 hours after transfer to the reactor. After this initial period, during which an interfacial reaction occurred between the azelaoyl chloride, the 3-methyl adipoyl chloride, the methyl hydroquinone and the p,p'-biphenol there resulted a liquid crystalline polyester shell. Potassium iodide (2.5 grams) was then added to the dispersion. The toner dispersion was then heated to 60° C. for 4 hours and for a further 10 hours at 80° C. The resulting toner material was washed three times with a basic sodium hydroxide aqueous solution (pH=10). Thereafter, the water medium was acidified (pH=3) with hydrochloric acid and washing was affected three more times with distilled water. Subsequently, the washed toner particles were spray dried at an inlet temperature of about 125° to 130° C. and an outlet temperature of about 55° to 60° C. with a Yamato DL-41 spray dryer to yield 87.2 grams of dry toner having an average particle size of about 8.0 microns as determined by scanning electron microscopy. There resulted a black toner containing as core a poly(n-butyl methacrylate), about 71 percent by weight, a styrene-n-butyl methacrylate copolymer, about 4.7 percent by weight, carbon black, about 5.9 percent by weight, and a polyester shell of about 18.4 percent by weight.

Thereafter, the shell release characteristics were measured using a heater plate on which was created a temperature gradient ranging from 60° to 130° C. A sample of these toner particles was distributed evenly between two xerographic papers which were put in contact with the hot plate. After reaching constant temperature, about one minute, the toner was gently pressed with a soft rubber roller against the plate and the two papers separated from one another. The toner prepared as described in the example has a sticking temperature of 93° C. A styrene-n-butyl methacrylate polymer resin having a sticking temperature of 90° C. was used as a standard in order to assure reproducibility in the determination of the sticking temperatures over a period of time. Scanning electron microscopy and transmission electron microscopy were used in order to evaluate the morphology of the particles and the shell integrity. It was found that the particles were spherical in shape with morphological characteristics identical to those described for Examples II and V. Thereafter, 3 parts by weight of the resulting toner composition was mixed with 100 parts by weight of a carrier consisting of an iron oxide core with a coating thereover of a polyvinylidine fluoride resin commercially available as Kynar, 0.14 percent coating weight. The triboelectric charge on the toner as measured in a known Faraday cage apparatus at a relative humidity of 50 percent was essentially zero microcoulombs per gram. Against a carrier consisting of an iron oxide core coated with a mixture of trifluorochloroethylene/vinyl chloride resin (65:35 weight ratio and 1.3 percent by weight), commercially available as FDC 461 from Firestone, the coating being doped with 7.5 percent of carbon black, Regal 330® (available from Cabot), the triboelectric charge was +11.6 microcoulombs per gram.

EXAMPLE X

A heat fusible encapsulated toner was prepared as follows: a styrene-n-butyl methacrylate copolymer of glass transition temperature of about 55° C. (7.95 grams) was dissolved in n-butyl methacrylate monomer (120.0 grams, available from Aldrich) in a 250 milliliter polyethylene bottle. A free radical polymerization initiator (0.4 gram of Vazo-52 from Polysciences), and carbon black (10.02 grams, Regal 330®, available from Cabot) were added to the n-butyl methacrylate solution. This solution was ball milled for 16 hours with about ⅓ by volume of 5 millimeter diameter ball bearings to produce a well dispersed pigment solution. Methyl hydroquinone (22.61 grams, available from Fluka, 98 percent) was dissolved in a separate bottle in water (150 milliliters) in presence of sodium hydroxide (16.02 grams). The ball milled solution was then transferred to a 250 milliliter polyethylene bottle (134.9 grams without the balls) to which was further added azelaoyl chloride (20.5 grams, available from Fluka, 95 percent), Vazo-52 (2.0 grams, available from Polysciences) and Vazo-64, another free radical polymerization initiator (2.4 grams, available from Polysciences). The resulting solution was dispersed with a PT 35/4G generator probe using a Brinkmann PT 45/80 homogenizer for 20 seconds at 8,000 rpm into a 0.7 percent, 500 milliliter, polyvinylalcohol, 88 percent hydroxylated, molecular weight 10,000 grams/mole, solution (available from Scientific Polymers Products) cooled at about 3° to 15° C. 2-decanol (Aldrich), 0.5 milliliter, was used to control foaming, and benzyl triethyl ammonium chloride (2.5 grams) was used as a phase transfer agent. Subsequently, the dispersion was transferred into a 2 liter reactor with a heating bath thereunder equipped with a mechanical stirrer and a reflux condenser. While stirring, the methyl hydroquinone solution was added over a period of 1 minute. The pH was monitored and adjusted with a solution of sodium hydroxide to pH equal 8 to 10. The dispersion was kept at room temperature for 3 hours after transfer to the reactor. After this initial period during which an interfacial reaction occurred between the azelaoyl chloride and the methyl hydroquinone there resulted a polyester shell. Potassium iodide (2.5 grams) was then added to the dispersion. The toner dispersion was then heated to 60° C. for 3½ hours and for a further 10 hours at 80° C. The resulting toner material was washed three times with a basic sodium hydroxide aqueous solution (pH=10). Thereafter, the water medium was acidified (pH=3) with hydrochloric acid and washing was affected three more times with distilled water.

Thereafter, the washed toner particles were spray dried at an inlet temperature of about 125° to 130° C. and an outlet temperature of about 55° to 60° C. with a Yamato DL-41 spray dryer to yield 94.0 grams of dry toner partially aggregated. There resulted a black toner containing as core a poly(n-butyl methacrylate), about 71 percent by weight, a styrene-n-butyl methacrylate copolymer, about 4.7 percent by weight, carbon black, about 5.9 percent by weight, and a polyester shell of about 18.4 percent by weight.

The shell release characteristics were measured using a heater plate on which was created a temperature gradient ranging from 60° to 130° C. A sample of these toner particles was distributed evenly between two xerographic papers which were put in contact with the hot plate. After reaching constant temperature, about one minute, the toner was gently pressed with a soft rubber roller against the plate and the two papers separated from one another. The toner prepared as described in the example has a sticking temperature of 82° C. A styrene-n-butyl methacrylate polymer resin having a sticking temperature of 90° C. was used as a standard in order to assure reproducibility in the determination of the sticking temperatures over a period of time. Scanning electron microscopy and transmission electron microscopy were used in order to evaluate the morphology of the particles and the shell integrity. It was found that the particles were spherical in shape with very smooth and uniform surfaces. There were no carbon black or dust particles at the surface of this toner.

Other modifications of the present invention may occur to those skilled in the art based upon a reading of the present disclosure, and these modifications are intended to be included within the scope of the present invention.

What is claimed is:

1. A process for the preparation of encapsulated toner compositions which comprises (1) providing a core comprised of a monomer capable of being polymerized by free radical polymerization, a colorant or pigment, a free radical initiator, a polymer and a first shell monomer dissolved in the core monomer; (2) dispersing said core components in an aqueous phase containing a surfactant, an antifoaming agent, and a phase transfer agent; (3) adding a second shell monomer to the aqueous phase; (4) encapsulating the core components by accomplishing polymerization of the first and second shell monomers; (5) heating the aqueous phase dispersion of (2) and (3) thereby effecting in situ polymerization of the core monomers; and (6) spheroidizing the polymerized shell of (4) by heating at a temperature of from about 20° to about 0° C. below the sticking temperature of the formed toner composition, and wherein the shell is comprised of a thermotropic liquid crystalline polymer.

2. A process in accordance with claim 1 wherein at least two core monomers are selected.

3. A process in accordance with claim 1 wherein from about 2 to about 4 shell monomers are selected.

4. A process in accordance with claim 1 wherein heat spheroidization is accomplished by heating at a temperature of from about 20° to about 0° C. below the sticking temperature of the formed toner composition.

5. A process in accordance with claim 1 wherein heat spheroidization is accomplished by heating at a temperature of from about 15° to about 0° C. below the sticking temperature of the formed toner composition.

6. A process in accordance with claim 1 wherein subsequent to heat spheroidization the resulting toner particles are washed, and thereafter dried.

7. A process for the preparation of encapsulated toner compositions which comprises (1) providing a core comprised of a monomer capable of being polymerized by free radical polymerization, a colorant or pigment, a free radical initiator, a polymer and a first shell monomer dissolved in the core monomer; (2) dispersing said core components in an aqueous phase containing a surfactant, an antifoaming agent, and a phase transfer agent; (3) adding a second shell monomer to the aqueous phase; (4) encapsulating the core components by accomplishing polymerization of the first and second shell monomers; (5) heating the aqueous phase dispersion of (2) and (3) thereby effecting polymerization of the core monomers; and (6) heat spheroidizing the polymerized shell at a temperature of from about 20° to about 0° C. below the sticking temperature of the resulting toner and wherein the shell is comprised of a thermotropic liquid crystalline polymer with a softening temperature of from about 40° to about 140° C.

8. A process in accordance with claim 7 wherein the resulting toner particles are washed, and thereafter dried.

9. A process in accordance with claim 7 wherein at least two core monomers are selected.

10. A process in accordance with claim 7 wherein heat spheroidization is accomplished at temperature of from about 15° to about 0° C. below the sticking temperature of the formed toner composition.

11. A process in accordance with claim 7 wherein the sticking temperature is from about 60° to about 120° C.

12. A process in accordance with claim 7 wherein the heat spheroidizing is accomplished at a temperature of from about 20° C. up to the sticking temperature of the shell.

13. A process in accordance with claim 7 wherein the antifoaming agent is an aliphatic alcohol.

14. A process in accordance with claim 13 wherein the aliphatic alcohol contains from about 8 to about 15 carbon atoms.

15. A process in accordance with claim 7 wherein the antifoaming agent is present in an amount of from about 0.01 to about 0.5 percent by weight.

16. A process in accordance with claim 7 wherein the antifoaming agent is 2-decanol.

17. A process in accordance with claim 7 wherein the phase transfer agent is present in an amount of from about 0.001 to about 1 percent by weight of water.

18. A process in accordance with claim 7 wherein the phase transfer agent is benzyl triethyl ammonium halide.

19. A process in accordance with claim 7 wherein the phase transfer agent is benzyl triethyl ammonium chloride.

20. A process in accordance with claim 7 wherein heat spheroidizing is accomplished at a temperature of from about 40° to about 140° C.

21. A process in accordance with claim 8 wherein washing is accomplished in basic water, followed by washing in acidic water, and thereafter in distilled water.

22. A process in accordance with claim 21 wherein the washed particles are subjected to spray drying.

23. A process in accordance with claim 7 wherein two or more core monomers are selected.

24. A process in accordance with claim 7 wherein the core is comprised of a polymer, a monomer and pigment particles encapsulated within a thermotropic liquid crystalline polymeric shell.

25. A process in accordance with claim 9 wherein the core is comprised of polymers, monomers and pigment particles encapsulated within a thermotropic liquid crystalline polymeric shell.

26. A process in accordance with claim 7 wherein the pigment is selected from the group consisting of carbon black, magnetites, cyan, magenta, red, yellow and mixtures thereof.

27. A process in accordance with claim 26 wherein the core is encapsulated within a thermotropic liquid crystalline polymeric shell formulated by an interfacial polymerization process.

28. A process in accordance with claim 1 wherein the polymeric shell generated is selected from the group consisting of thermotropic liquid crystalline polycarbonates, copolycarbonates, polyurethanes, polyesters, copolyesters, polyamides, copolyamides, and polyester amides.

29. A process in accordance with claim 7 wherein the polymeric shell generated is selected from the group consisting of thermotropic liquid crystalline polycarbonates, copolycarbonates, polyurethanes, polyesters, copolyesters, polyamides, copolyamides, and polyester amides.

30. A process in accordance with claim 7 wherein the polymer is selected from the group consisting of polystyrene, poly(styrene-acrylate) copolymers, poly(styrene-methacrylate) copolymers, poly(styrenebutadiene) copolymers, polyacrylates, polymethacrylates, polycyanoacrylates, polycyanomethacrylates, poly($\beta$-methyl alcoyl vinyl ethers), poly(isoprenyl methyl ketone), and mixtures thereof.

31. A process in accordance with claim 7 wherein the resulting toner contains additive particles selected from the group consisting of colloidal silicas, metal salts, and metal salts of fatty acids.

32. A process in accordance with claim 31 wherein the additive particles are comprised of zinc stearate.

33. A process in accordance to claim 7 wherein the polymeric shell is prepared by the interfacial polymerization of p,p'-biphenol, methyl p-benzoquinone, and aliphatic acid halides.

34. A process in accordance to claim 7 wherein the polymeric shell has a softening point of from about 60° to about 140° C.

35. A process in accordance to claim 7 wherein the shell releases the core components with minimum pressure upon heating from about 70° to about 120° C.

36. A process in accordance with claim 35 wherein heating is accomplished at a temperature of from about 80° to about 100° C.

37. A process for the preparation of developer compositions which comprises admixing the toner compositions of claim 1 and carrier particles.

38. A process for the preparation of developer compositions which comprises admixing the toner composition of claim 7 and carrier particles.

39. A process in accordance with claim 38 wherein the carrier particles contain a coating thereover.

40. A process in accordance with claim 39 wherein the coating is comprised of a polymer, and the core of the carrier is comprised of a ferrite or steel.

41. A process in accordance with claim 40 wherein the coating is selected from the group consisting of a fluorinated polymer, polystyrene, and a terpolymer of styrene, butyl methacrylate organotriethoxy silane.

42. A process in accordance with claim 1 wherein the monomer is present in an amount of from about 30 to about 50 percent by weight of the toner and the prepolymerized copolymer or polymer is present in an amount of from about 1 percent by weight to about 30 percent by weight of the toner.

43. A process in accordance with claim 7 wherein the pigment is present in an amount of from about 3 to about 20 percent by weight of the toner.

44. A process in accordance with claim 7 wherein the shell is present in an amount from about 1 to about 25 percent by weight.

45. A process in accordance with claim 7 wherein the surfactant is a partially hydroxylated polyvinylalcohol.

46. A process in accordance with claim 7 wherein the surfactant is present in an amount of from about 0.05 to about 3 percent by weight of water.

47. A process in accordance with claim 7 wherein the initiators are comprised of 2,2'azo-bis-isobutyronitrile and 2,2'azo-bis-2,4-dimethylvaleronitrile.

48. A process in accordance with claim 7 wherein the initiators are present in an amount from about 0.01 to about 8 percent by weight of monomer.

49. A process in accordance with claim 7 wherein the water is rendered basic with sodium hydroxide and acidic with hydrochloric acid.

50. A process for the preparation of encapsulated toner compositions which comprises (1) providing a core comprised of a monomer capable of being polymerized by free radical polymerization, a colorant or pigment, a free radical initiator, a polymer and a first shell monomer dissolved in the core monomer; (2) dispersing said core components in an aqueous phase containing a surfactant, an antifoaming agent, and a phase transfer agent; (3) adding a second shell monomer to the aqueous phase; (4) encapsulating the core components by accomplishing polymerization of the first and second shell monomers; (5) heating the aqueous phase dispersion of (2) and (3) thereby effecting polymerization of the core monomers; and (6) spheroidizing the polymerized shell of (4) by heating at a temperature of from about 20° to about 0° C. below the sticking temperature of the formed toner composition, and wherein said polymeric shell has a softening temperature of from about 60° to about 140° C.

* * * * *